US009428936B2

(12) United States Patent
Fenayon

(10) Patent No.: US 9,428,936 B2
(45) Date of Patent: Aug. 30, 2016

(54) LOCK FOR A MOTOR VEHICLE LOCK SYSTEM

(71) Applicant: VALEO SECURITE HABITACLE, Creteil (FR)

(72) Inventor: Ludovic Fenayon, Creteil (FR)

(73) Assignee: VALEO SECURITE HABITACLE, Creteil (FR)

( * ) Notice: Subject to any disclaimer, the term of this patent is extended or adjusted under 35 U.S.C. 154(b) by 0 days.

(21) Appl. No.: 14/184,370

(22) Filed: Feb. 19, 2014

(65) Prior Publication Data

US 2014/0230501 A1 Aug. 21, 2014

Related U.S. Application Data

(63) Continuation of application No. 13/821,784, filed as application No. PCT/EP2011/004499 on Sep. 7, 2011, now abandoned.

(30) Foreign Application Priority Data

Sep. 9, 2010 (FR) ..... 10 03594

(51) Int. Cl.
*E05B 9/04* (2006.01)
*E05B 77/44* (2014.01)
*E05B 85/06* (2014.01)

(52) U.S. Cl.
CPC ..... *E05B 9/04* (2013.01); *E05B 77/44* (2013.01); *E05B 85/06* (2013.01); *Y10T 70/7486* (2015.04)

(58) Field of Classification Search
CPC ..... E05B 15/00; E05B 9/084; E05B 17/002; E05B 17/0012; E05B 17/14; E05B 17/142; E05B 79/00; E05B 79/02; E05B 79/04; E05B 79/06; E05B 79/08; E05B 83/01; E05B 77/44; E05B 85/06; E05B 9/04; Y10T 70/7486
USPC ..... 70/370, 372, 379 R, 379 A, 380, 423, 70/424, 427, 428, 454, 455, 416, 466, 237, 70/452, 371
See application file for complete search history.

(56) References Cited

U.S. PATENT DOCUMENTS 1,882,626 A * 10/1932 Jacobi ..... 70/369
2,580,548 A * 1/1952 Jacobi ..... 70/370

(Continued)

FOREIGN PATENT DOCUMENTS

EP 1026343 A1 * 8/2000
FR 2944544 A1 * 10/2010
WO WO 2010118988 A1 * 10/2010

OTHER PUBLICATIONS

Smith, David A.. (2001). Die Maintenance Handbook—Front Matter. Society of Manufacturing Engineers (SME). Online version available at: http://app.knovel.com/hotlink/pdf/id:kt00A1N9N4/die-maintenance-handbook/front-matter.*

*Primary Examiner* — Suzanne Barrett
*Assistant Examiner* — Amanda L Miller
(74) *Attorney, Agent, or Firm* — Osha Liang LLP

(57) ABSTRACT

A lock that is inserted and fixed in a receiving body of a motor vehicle is disclosed. The lock includes a stator inside which a rotor rotatably moves. The stator is fixed to the receiving body and includes a cover plate of the rotor fixed to the front face of the stator, where the cover plate has an opening for a key. There is also an anti-pull-out mechanism borne by said cover plate and the stator to fix the cover plate to the stator and to retain the rotor axially in the stator. The anti-pull-out mechanism blocks the cover plate axially on the stator by the positioning of the cover plate and its subsequent pivoting on the stator into an assembled position. The anti-pull-out mechanism includes an element for blocking in rotation the cover plate on the stator interposed between the cover plate and the front face of the stator.

11 Claims, 2 Drawing Sheets

(56) References Cited

U.S. PATENT DOCUMENTS

| | | | | | |
|---|---|---|---|---|---|
| 2,679,557 | A | * | 5/1954 | Miller | 200/11 C |
| 2,689,700 | A | * | 9/1954 | Drury | 248/27.1 |
| 2,745,275 | A | * | 5/1956 | Jacobi | 70/370 |
| 2,988,910 | A | * | 6/1961 | Eshbaugh et al. | 70/173 |
| 3,503,233 | A | * | 3/1970 | Armstrong et al. | 70/370 |
| 4,139,998 | A | * | 2/1979 | Jeavons et al. | 70/370 |
| 4,424,691 | A | * | 1/1984 | Foshee | 70/224 |
| 4,562,709 | A | * | 1/1986 | Canadas et al. | 70/169 |
| 4,586,354 | A | * | 5/1986 | Smith | 70/451 |
| 4,611,477 | A | * | 9/1986 | Crites | 70/416 |
| 4,631,944 | A | * | 12/1986 | Gater et al. | 70/472 |
| 4,716,745 | A | * | 1/1988 | Hehn | 70/58 |
| 5,297,405 | A | * | 3/1994 | Manning et al. | 70/208 |
| 5,697,238 | A | * | 12/1997 | Oike | 70/373 |
| 6,058,746 | A | * | 5/2000 | Mirshafiee et al. | 70/107 |
| 6,502,439 | B1 | * | 1/2003 | Stirling et al. | 70/370 |
| 6,508,092 | B1 | * | 1/2003 | Laabs et al. | 70/370 |
| 6,523,379 | B2 | * | 2/2003 | Teskey | 70/371 |
| 6,595,033 | B1 | * | 7/2003 | Hara et al. | 70/370 |
| 7,472,570 | B2 | * | 1/2009 | Yamaguchi et al. | 70/379 R |
| 7,900,489 | B2 | * | 3/2011 | Roth et al. | 70/134 |
| 7,987,688 | B2 | * | 8/2011 | Thizon et al. | 70/370 |
| 2008/0196455 | A1 | * | 8/2008 | Desarmenien | 70/91 |

* cited by examiner

LOCK FOR A MOTOR VEHICLE LOCK SYSTEM

FIELD OF THE INVENTION

The invention relates to a lock for a motor vehicle lock system. More particularly, the invention relates to a rotating electric commutator lock for a motor vehicle anti-theft device but may also be applied to any motor vehicle lock.

BACKGROUND OF THE INVENTION

Such a lock designed to be inserted and fixed in a receiving body of a motor vehicle comprises:

- a stator inside which a rotor is capable of being mobile in rotation when a key appropriate for the lock is inserted so as to unlock the lock system of the motor vehicle, said stator comprising a means for fixing to said anti-theft body,
- a cover plate of the rotor fixed to the front face of said stator, said cover plate having an opening for the passage of the key capable of cooperating with said rotor,
- an anti-pull-out means borne by said cover plate and said stator to fix said cover plate to said stator and to retain said rotor axially in said stator.

It is known to retain the cover plate at the front of the stator of the lock by a crimped portion located to the rear of the cover plate, making it possible to ensure the integrity of the lock, in particular in the event of the rotor being pulled out or pushed in.

However, a different means is sought to fix the lock to the anti-theft body, making it possible to reduce the costs resulting from the crimping step whilst improving the integrity of the lock.

SUMMARY OF THE INVENTION

The present invention aims to remedy this problem by proposing a lock designed to be inserted and fixed in a receiving body of a motor vehicle comprising:

- a stator inside which a rotor is capable of being mobile in rotation, said stator (3) comprising a means for fixing to said receiving body,
- a cover plate of the rotor fixed to the front face of said stator, said cover plate having an opening for the passage of a key capable of cooperating with said rotor,
- an anti-pull-out means borne by said cover plate and said stator to fix said cover plate to said stator and to retain said rotor axially in said stator, characterized in that said anti-pull-out means is configured to block said cover plate axially on said stator by the positioning of said cover plate on said stator and its subsequent pivoting on said stator into an assembled position and in that it comprises an element for blocking in rotation said cover plate on said stator, consisting of a part interposed between the cover plate and the front face of the stator.

The cover plate may thus be mounted manually on the stator such that the assembly requires neither a specific tool nor an assembly station. This results in a significant reduction in production and assembly costs.

According to a preferred embodiment, said part comprises a means for fixing in rotation to the front face of said stator and a means for blocking in rotation said active cover plate in said assembled position.

Preferably, said blocking means consists of at least one resilient lug inclined in the resting position and each designed to cooperate with a groove borne by the rear face of said cover plate, in said assembled position.

Preferably, said fixing means consists of at least one groove for longitudinal interlocking with a rib borne by the front face of the stator.

Advantageously, said part constitutes an intermediate cover plate of the rotor, which is cup-shaped with an open base and comprises a peripheral annular flange comprising at least one resilient lug inclined to the front in the resting position, forming said blocking means, and each designed to cooperate with a groove borne by the rear face of said cover plate, in said assembled position.

Advantageously, said annular flange of said intermediate cover plate comprises at least one so-called groove for longitudinal interlocking with a rib borne by the front face of the stator, forming said fixing means.

Said part may be made of steel.

Preferably, said cover plate is fixed to said stator by a bayonet mounting forming said anti-pull-out means to retain said rotor axially in said stator.

Advantageously, the stator has a rib having a plane generally perpendicular to the longitudinal axis of the lock and the cover plate has a corresponding hook for a bayonet mounting.

The lock may further comprise a longitudinal element for taking up clearance of said cover plate on said stator.

Said element for taking up clearance may be generally strip-shaped and comprise means for assembling to said stator and said cover plate.

Said element for taking up clearance may have a longitudinal lug in abutment against said cover plate.

Said element for taking up clearance may be made of plastics material.

BRIEF DESCRIPTION OF THE DRAWINGS

The invention is described in more detail hereinafter with reference to the figures showing a preferred embodiment of the invention.

DETAILED DESCRIPTION

Figures 1A, 1B, 1C, 1D:
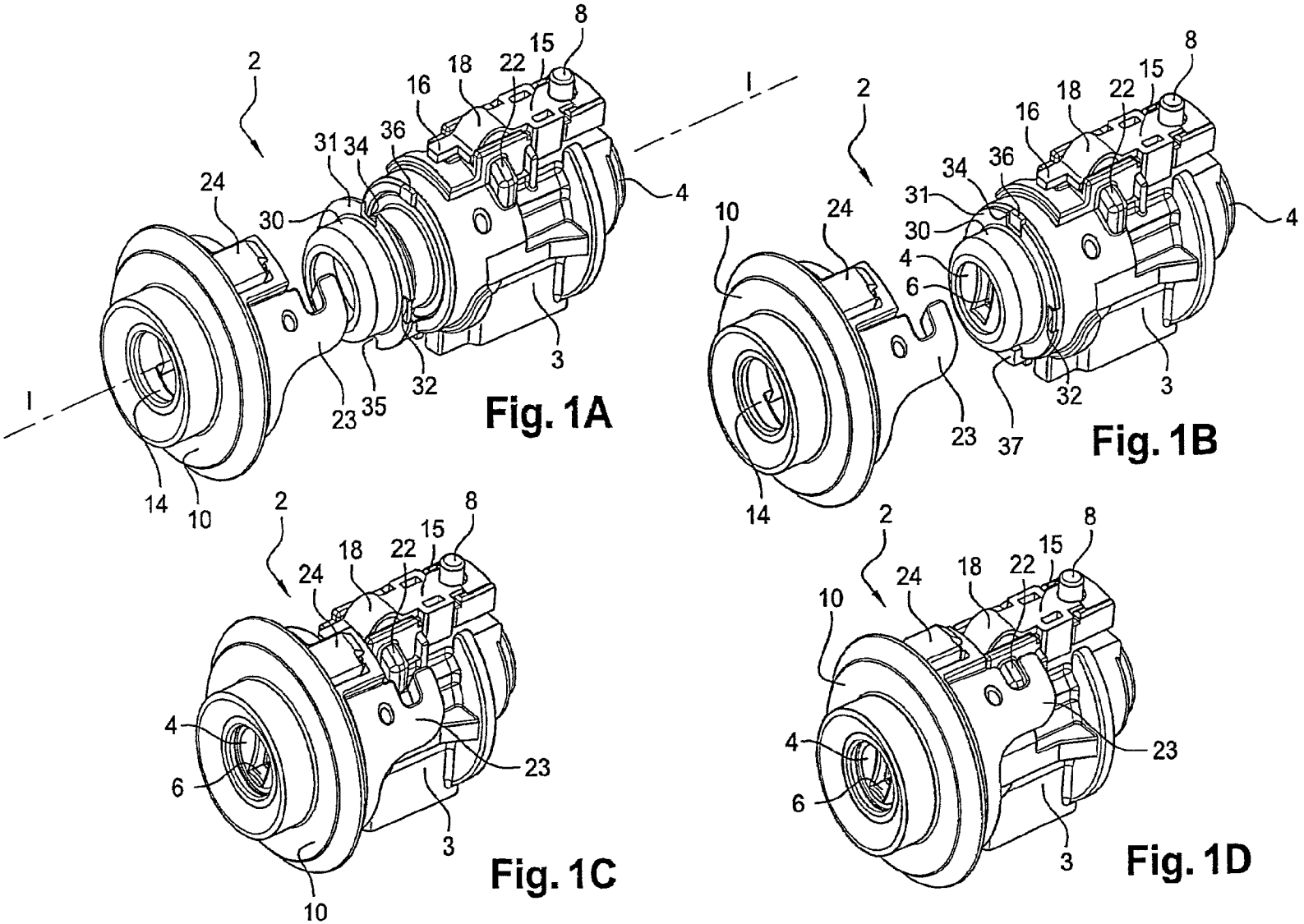
FIGS. 1A to 1D are perspective views of a lock according to the invention.

In all the figures, identical elements bear the same reference numerals. The front face of the lock is designated as the end of the lock accessible by the user from the outside of the motor vehicle.

Figure 2:
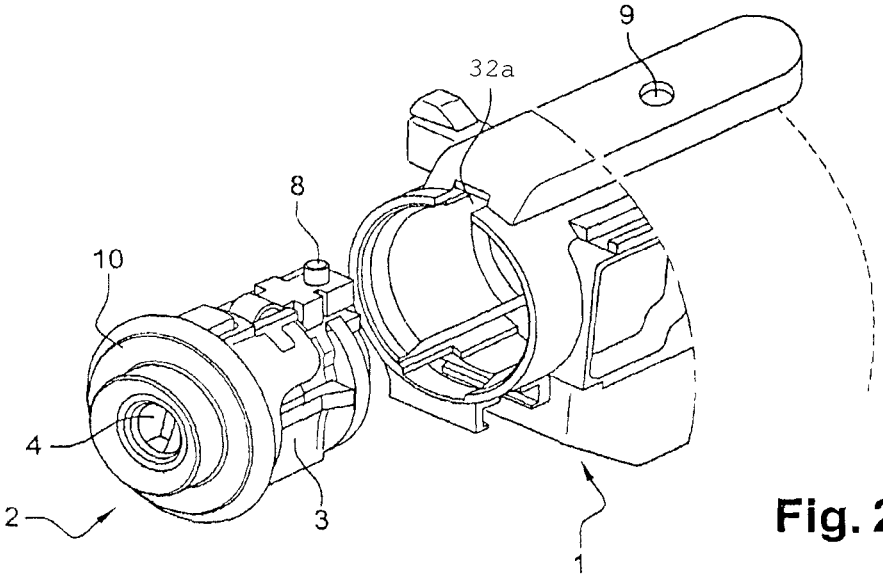
FIG. 2 is a perspective view of a lock and a lock body according to the invention.
Figure 3:
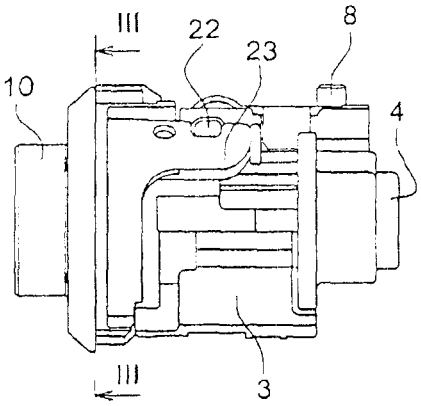
FIG. 3 is a side view of a lock according to the invention.

FIGS. 1, 2 and 3 illustrate an anti-theft device with an insertable lock, designed to be mounted in a motor vehicle to secure the steering thereof. The anti-theft device comprises a receiving body 1 which is an anti-theft body according to the illustrated embodiment, having a first portion in which locking means are integrated, designed to block a mobile steering element (not visible). The anti-theft body 1 is also provided with a second portion into which a lock 2 is designed to be inserted and fixed. The lock 2 comprises a stator inside which a rotor 4 is mounted to control the implementation of the locking means via a connecting element (not visible). The connecting element has an end shaped so as to be able to be interlocked in a corresponding cavity to the rear of the lock 2 and thus cooperate by entrainment with the rotor part 4 of the lock 2.

The rotor 4 is capable of being mobile in rotation along the longitudinal axis I-I inside the stator 3 when a key appropriate for the lock 2 is inserted into the rotor 4 via the key inlet 6 formed at the front end of the rotor 4, so as to unlock the lock system of the motor vehicle.

It goes without saying that, throughout this text, the term "rotor" denotes very generally any sub-assembly comprising a rotor body through which radial slots are formed, capable of receiving tumblers which are assembled so as to be mobile in radial translation and which are coupled to restoring springs which drive them permanently into positions which protrude relative to the body of the rotor.

The lock stator 3 also has a means for fixing to the anti-theft body 1 to secure the lock 2 to the anti-theft body 1. According to an embodiment shown, said fixing means has a resilient stud 8, for example mounted on the spring, placed on the surface of the stator 3 of the lock 2, cooperating with a corresponding orifice 9 having a shape which is substantially complementary to the stud 8, formed inside the second portion of the anti-theft body 1.

The lock 2 comprises a cover plate 10 designed to be fixed to the front face of the stator 3. The cover plate 10 has a circular opening 14 to make the key inlet 6 formed at the front end of the rotor 4 accessible. The cover plate 10 is made from a material resistant to being pulled out, for example made of a material of the Zamak type, Zamak being an alloy based on zinc, aluminum and magnesium, occasionally with copper.

The lock 2 is placed in the anti-theft body 1 such that the key inlet 6 is accessible from the outside of the motor vehicle.

The lock 2 comprises an anti-pull-out means borne by the cover plate 10 and the stator 3 to fix the cover plate 10 to the stator 3 and to retain the rotor 4 axially in the stator 3. The presence of an anti-pull-out means is essential in order to ensure the integrity of the rotor 4 of the lock 2, in particular relative to potential attempted break-ins by pulling out or pushing in the rotor 4.

The anti-pull-out means is configured to block the cover plate 10 axially on the stator 3 by the positioning of the cover plate 10 on the stator 3 and its subsequent pivoting on said stator 3 into the assembled position shown in FIG. 1D. The mounting may thus be carried out manually such that no specific tool or assembly station is required. This results in a significant reduction in production and assembly costs.

The insertion of the lock 2 into the anti-theft body 1 then definitively locks the rotation of the cover plate 10. To achieve this, the anti-theft body 1 comprises an anti-unscrewing means for the cover plate 10 on the stator 3.

According to the preferred embodiment, the cover plate 10 is fixed to the stator 3 by a bayonet-type mounting, i.e. the cover plate 10 is positioned on the stator 3 and is pivoted so as to be retained in the axially blocked position. The bayonet mounting forms an anti-pull-out means, so as to block the rotor 4 in axial translation inside the stator 3 when the lock 2 is fixed inside the anti-theft device 1. The resistance of the lock relative to the rotor being pushed in or pulled out is thus enhanced by the bayonet-type mounting which permits improved resistance against being pulled out.

According to a preferred embodiment, the stator 3 has a rib 22 having a plane generally perpendicular to the longitudinal axis I-I and the edge of the cover plate 10 has a corresponding hook 23. The hook 23 cooperates with the rib 22 to retain the cover plate 10 axially.

In addition, the cover plate comprises an anti-unscrewing longitudinal rib 24 designed to cooperate with a housing 32*a* formed in the vicinity of the mouth of the anti-theft body 1.

The lock 2 also comprises a longitudinal element for taking up clearance 15 made of plastics material. Said element for taking up clearance 15 makes it possible to take up clearance which potentially may be present between the cover plate 10 and the stator 3 of the lock and thus eliminate noise caused by a relative movement between the cover plate 10 and the stator 3 when transporting the lock 2 on the vehicle assembly line and once mounted in the anti-theft device. The element for taking up clearance 15 is generally strip-shaped, for example, and comprises means for assembling to the stator 3.

The element for taking up clearance 15 may be fixed by being clipped to the stator 3 of the lock 2. It comprises a resilient guard 18, for example, formed by a curved strip in order to take up clearance tolerances, a longitudinal lug 16 borne by said element being in abutment against the cover plate.

According to the invention, the lock also comprises a means for blocking in rotation the cover plate 10, consisting of a part 30 interposed between the cover plate 10 and the front face of the stator 3.

Figure 5A:
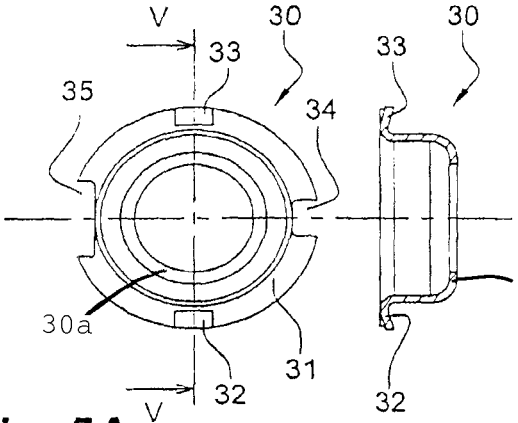
FIGS. 5A to 5B are detailed views from the front and in section along V-V of a lock according to the invention.
Figure 5B:
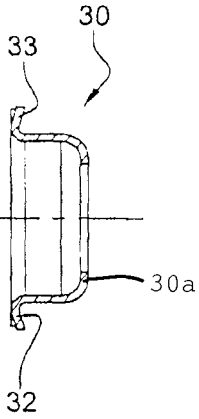

According to the illustrated embodiment, said part 30 which is cup-shaped with an open base and constitutes an intermediate cover plate visible in FIGS. 1A and 1B is shown on its own in FIGS. 5A and 5B. Said part 30 thus also has the function of a tamper protection shield for the rotor in addition to its function of blocking in rotation the cover plate 10, due to its open front wall or open base 30A which partially covers the front face of the rotor.

Said intermediate cover plate 30 of cylindrical shape and advantageously made of steel, optionally stainless steel, comprises a means for fixing in rotation to the front face of the stator 3 and a means for blocking in rotation of the cover plate 10, the means for blocking in rotation being active in the assembled position shown in FIGS. 1D and 3.

Figure 4A:
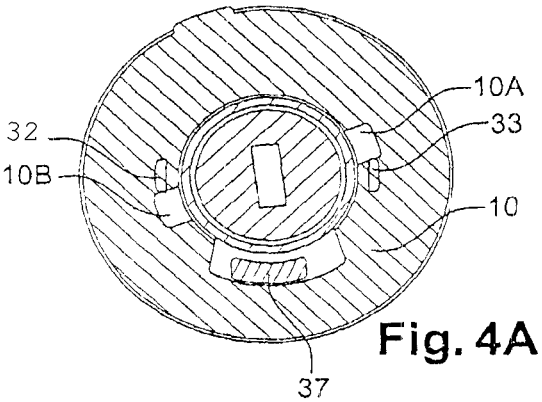
FIGS. 4A to 4B are sectional views according to the plane III-III.
Figure 4B:
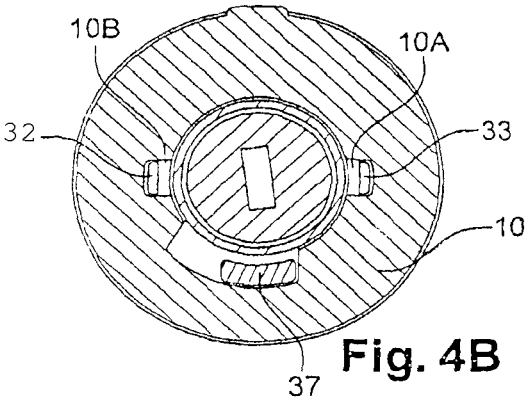

The intermediate cover plate comprises a peripheral annular flange 31 comprising at least one resilient lug 32, 33 inclined to the front in the resting position, forming said blocking means, and designed to cooperate with grooves 10A, 10B visible in FIGS. 4A and 4B and borne by the rear face of the cover plate 10, in said assembled position. According to the example shown, said lugs are two in number, as are the corresponding grooves.

The annular flange 31 of the intermediate cover plate comprises at least one groove, in this case two grooves 34, 35, for longitudinal interlocking with a rib, in this case two ribs 36, 37 borne by the front face of the stator, forming the fixing means.

The assembly of a lock 2 according to the invention is carried out in the following manner.

As illustrated in FIGS. 1A and 1B, the intermediate cover plate 30 is arranged on the front face of the stator 3 by the interlocking of the ribs 36, 37 thereof in the grooves 34, 35 borne by said intermediate cover plate. In this position, the resilient lugs 32, 33 are in the resting position, inclined to the front.

The cover plate 10 is then applied to said intermediate cover plate 30, as illustrated in FIG. 1C, the resilient lugs 32, 33 being compressed and urged into the non-inclined position as illustrated in FIG. 4A and the hook 23 of the cover plate 10 being arranged opposite the rib 22 of the stator 3.

The cover plate is finally pivoted, so as to interlock the hook 23 on the rib 22, as shown in FIG. 1D where the lock is in the assembled position. The resilient lugs 32, 33 of the intermediate cover plate 30 are then released into an inclined position in the ribs 10A, 10B of the cover plate 10, blocking in rotation said cover plate.

Said assembled lock may now be inserted into the body of the lock 1 shown in FIG. 2 where the rotation of the cover plate 10 is locked definitively by the interlocking of the longitudinal anti-unscrewing rib 24 of the cover plate in the housing 32*a* of the lock body.

A preferred embodiment of the invention is described above but the invention also encompasses further embodiments of the part 30 for blocking in rotation the cover plate.

The tamper protection function may be ensured solely by the cover plate 10 and the part 30 may be of semi-cylindrical shape. Said part may thus be without a front wall 30A.

Said part may even be without a peripheral annular flange 31 and consist of a simple cylindrical ring. Said blocking means may thus consist of at least one resilient lug inclined on, and relative to, the cylindrical wall of said part in the resting position, and each designed to cooperate with a radial groove borne by the rear face of said cover plate, in said assembled position. Similarly, said fixing means may thus always consist of at least one groove for longitudinal interlocking, arranged at the end of said cylindrical wall, with a rib borne by the front face of the stator, forming said fixing means. In this case, as the part does not play a shielding role, it may be made of plastics material.

Generally, said blocking means consists of at least one resilient lug inclined in the resting position and each designed to cooperate with a groove borne by the rear face of said cover plate (10), in said assembled position. In addition, said fixing means consists of at least one groove for longitudinal interlocking with a rib borne by the front face of the stator (3), forming said fixing means.

The invention claimed is:

1. A lock configured to be inserted and fixed in a receiving body of a motor vehicle comprising:

a stator inside which a rotor is capable of being mobile in rotation, said stator comprising a means for fixing to said receiving body;

a cover plate of the rotor fixed to a front face of said stator, said cover plate having an opening for passage of a key which cooperates with said rotor;

a first anti-pulling-out means borne by said cover plate;

a second anti-pulling-out means borne by said stator to fix said cover plate to said stator and to retain said rotor axially in said stator, wherein said first and second anti-pulling-out means are configured to block said cover plate axially on said stator by positioning of said cover plate on said stator and a subsequent pivoting of said cover plate on said stator into an assembled position; and a third anti-pulling-out means comprising an element for blocking in rotation of said cover plate on said stator, consisting of a part interposed between the cover plate and the front face of the stator, wherein said part comprises a means for fixing in rotation to the front face of said stator and a means for blocking in rotation of said cover plate, the means for blocking in rotation being active in said assembled position, and wherein said means for blocking in rotation consists of at least one resilient lug inclined toward a front of the lock in a resting position, the resilient lug being configured to cooperate with a groove borne by a rear face of said cover plate, in said assembled position.

2. The lock as claimed in claim 1, wherein said means for fixing in rotation consists of at least one groove for longitudinal interlocking with a rib borne by the front face of the stator.

3. The lock as claimed in claim 1, wherein said part consists of a second and an intermediate cover plate of the rotor, which is cup-shaped and comprises a peripheral annular flange comprising at least one resilient lug forwardly-inclined in a resting position, forming said means for blocking in rotation, and each designed to cooperate with a groove borne by a rear face of said cover plate, in said assembled position.

4. The lock as claimed in claim 3, wherein said annular flange of said intermediate cover plate comprises at least one groove for longitudinal interlocking with a rib borne by the front face of the stator, forming said means for fixing in rotation.

5. The lock as claimed in claim 1, wherein said part is made of steel.

6. The lock as claimed in claim 1, wherein said cover plate is fixed to said stator by a bayonet mounting formed by said first and second anti-pulling-out means to retain said rotor axially in said stator.

7. The lock as claimed in claim 6, wherein the stator has a rib having a plane generally perpendicular to the longitudinal axis of the lock and the cover plate has a corresponding hook for the bayonet mounting.

8. The lock as claimed in claim 1, further comprising a longitudinal element for taking up clearance of said cover plate on said stator.

9. The lock as claimed in claim 8, wherein said element for taking up clearance is generally strip-shaped and comprises means for assembling to said stator and to said cover plate.

10. The lock as claimed in claim 8, wherein said element for taking up clearance has a longitudinal lug in abutment against said cover plate.

11. The lock as claimed in claim 8, wherein said element for taking up clearance is made of plastic material.

* * * * *